United States Patent [19]

Coles et al.

[11] 4,274,540

[45] Jun. 23, 1981

[54] CONTAINERS AND SUPPORT COMBINATIONS

[76] Inventors: Eric R. Coles, 2 Charnwood Grove; Rex K. Walden, 20 Forest Rd., both of Bingham, Nottinghamshire, England

[21] Appl. No.: 839,291

[22] Filed: Oct. 4, 1977

[51] Int. Cl.[3] ..... B65D 19/44

[52] U.S. Cl. ..... 206/597; 108/55.1; 217/43 A; 229/23 R; 248/500

[58] Field of Search ..... 224/26 R, 26 G, 273, 224/319; 229/16 R, 16 D, 18, 23 R, 23 A, 23 C, 23 AB, 41 B, 46, 49, 50, 59, 37 R, 37 E; 206/216, 223, 541, 549, 577, 386, 521, 595, 597, 599, 600; 248/146, 151, 500, 152, 346; 105/463, 464, 465; 108/51.1, 51.3, 55.1, 55.3, 55.5; 280/79.2, 179 R, 179 A; 217/43 A; 410/55, 76, 85, 96

[56] References Cited

U.S. PATENT DOCUMENTS

| | | | |
|---|---|---|---|
| 1,342,951 | 6/1920 | Gagne | 248/151 |
| 2,494,730 | 1/1950 | Thursby | 229/16 R |
| 2,965,276 | 12/1960 | Foster | 229/23 C |
| 3,063,667 | 11/1962 | Doty et al. | 248/151 X |
| 3,408,027 | 10/1968 | Price | 248/151 |
| 3,478,995 | 11/1969 | Lautzenhiser et al. | 108/55.5 X |
| 3,608,600 | 9/1971 | Lehrman | 248/151 X |
| 3,918,630 | 11/1975 | Meyers | 229/49 X |
| 3,964,607 | 6/1976 | Wagner | 229/23 R X |
| 4,015,715 | 4/1977 | Kelf | 206/386 X |
| 4,019,634 | 4/1977 | Bonnot | 229/23 R X |
| 4,077,532 | 3/1978 | Bryan | 108/55.3 X |
| 4,091,923 | 5/1978 | Collins | 206/386 |

FOREIGN PATENT DOCUMENTS

| | | | |
|---|---|---|---|
| 2327317 | 12/1974 | Fed. Rep. of Germany | 206/386 |
| 2291105 | 6/1976 | France | 248/146 |

*Primary Examiner*—David A. Scherbel
*Assistant Examiner*—Jerold M. Forsberg
*Attorney, Agent, or Firm*—Stevens, Davis, Miller & Mosher

[57] ABSTRACT

A container for goods, in which the base of the container on which the goods are to rest comprises flaps folded towards one another from sides of the container, the folds thereby defining a lower peripheral edge around the container, and a support which in use spaces the container base from the ground, the underside of the container being secured to the support by tongues which are retained on the container and emerge through apertures in said lower peripheral edge of the container to engage cooperating clips on the support. A kit for assembling the container is also disclosed, comprising a blank from which can be folded a container having the features outlined above, and a support having clips for receiving tongues fitted to the folded blank. Two kinds of cooperating clips and tongues are specifically described and illustrated.

7 Claims, 7 Drawing Figures

--FIG.1--
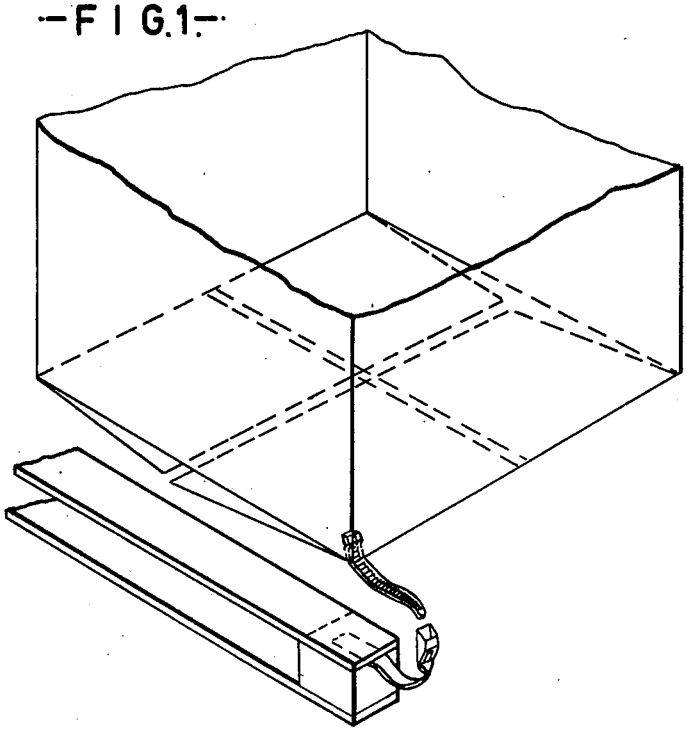
--FIG.2--
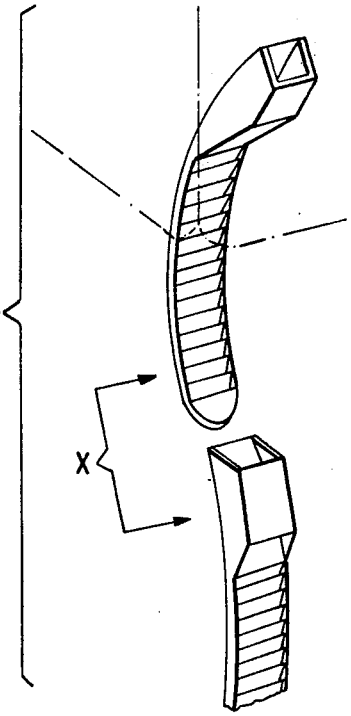
--FIG.2A--
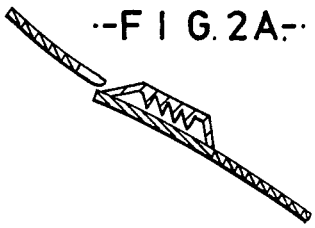

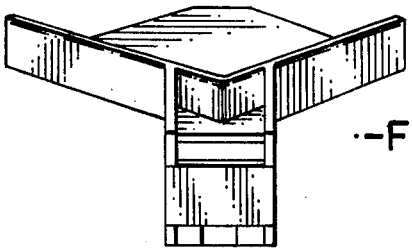
-FIG.3A.-
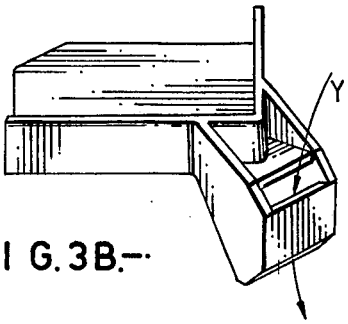
-FIG.3B.-
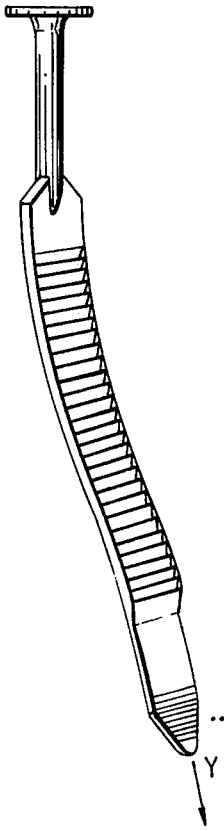
-FIG.3D.-
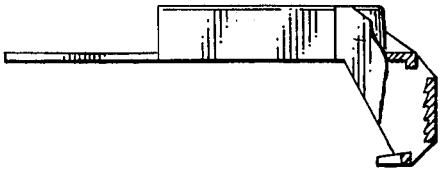
-FIG.3C.-

CONTAINERS AND SUPPORT COMBINATIONS

FIELD OF THE INVENTION

The invention relates to containers, and in this specification the term "container" is intended to include within its scope such things as pallets, cartons and cases, to all of which the invention is equally applicable.

SUMMARY OF THE INVENTION

According to one aspect of the invention there is provided a container for goods, in which the base of the container on which goods are to rest comprises flaps folded towards one another from sides of the container, the folds thereby defining a lower peripheral edge around the container, and a support which in use spaces the container base from the ground, characterized in that the underside of the container is secured to the support by a tongue which is retained on the container and emerges through an aperture in said lower peripheral edge of the container to engage a co-operating clip on the support.

The flaps may be folded from alternate sides of the container and overlap to form the container base.

In this case, tongues may emerge from the corner apertures which are automatically formed at the junction of adjacent flaps as they are folded towards one another.

In this last mentioned case, the container is preferably rectangular with tongues emerging from each of the four corner apertures.

In any of these arrangements, the or each tongue may emerge from inside the container and that part of the tongue which is inside the container ends in an enlarged portion which will not pass through said aperture.

The invention includes within its scope a kit of parts for assembling a container and support embodying the invention, the kit comprising a blank from which can be formed a container whose base comprises flaps folded towards one another from side portions of the blank to define a lower peripheral edge around the container; a support which when secured to the underside of the assembled container will space the base of the container from the ground; a number of clips on the support; and a corresponding number of tongues, each of which can be pushed through an associated aperture formed in said lower peripheral edge of the assembled container to emerge from said aperture whilst being retained on the container and engage a cooperating one of said number of clips to secure the support to the underside of the container.

BRIEF DESCRIPTION OF THE DRAWINGS

FIG. 1 shows in perspective a container and support embodying the invention;

FIGS. 2 and 3 show respective alternative forms of tongue and clip for use with the container and support of FIG 1;

FIG. 2A is a cross-section on the line X—X of FIG. 2;

FIG. 3A shows an alternative clip in front perspective;

FIG. 3B shows the clip of FIG. 3A in side perspective;

FIG. 3C shows the clip of FIGS. 3A and 3B in side elevation and partly sectioned; and FIG. 3D shows a headed tongue which is adapted to engage with the clip of FIGS. 3A, 3B and 3C.

DESCRIPTION OF THE PREFERRED EMBODIMENT

FIG. 1 shows in part-perspective a container and support embodying the invention. The container is in the form of a case which is rectangular in plan and is folded from a blank to comprise four sidewalls, a base and a top (not shown). The base of the container is formed from flaps which are folded towards one another from alternate sides of the container to overlap, and the fold lines of the flap thereby define a lower peripheral edge around the container. The top of the container is formed from flaps similarly folded towards one another from alternate side portions of the blank, these flaps being folded along lines parallel to the base flaps and then being either stapled, strapped or taped closed when in use.

The assembled container is spaced from the ground on which it stands in use by a support. In this example, the support comprises two battens, of which one is shown in the drawing, the two battens being spaced apart and running parallel to one another along opposite ends of the container. The supports comprise elongate wooden strips with wooden blocks nailed between them at each end, and the wooden strips are so spaced by the blocks as to permit entry of the forks of a fork lift truck between them.

There is secured to the underside of each support a plastic clip of the kind sold commercially under the name "colson legrand". These clips are commonly used as cable clips in the electrical industry, and as shown in FIG. 2A they comprise an elongate strip of plastics material having an enlarged head at one end, the strip and the head both being formed with a series of serrations. A tongue in the form of a further such clip is pushed from inside the container through the corner aperture automatically formed when the base flaps where folded towards one another to form the base, and the head of this further clip retains it on the container. The emerging end of the further clip can then be pushed through the head of the clip secured to the support, and pulled tight to cause the two sets of serrations to interlock.

One such co-operating pair of clips thus secures each corner of the container to the support, and with this particular form of clip the container can only be released from the support by cutting the tongue of the clip retained on the container.

It will be appreciated that modifications can be made to this embodiment which still fall within the scope of the invention. For example, each co-operating tongue and clip could take the form of a touch and close fastening means such as "VELCRO" (Registered Trade Mark) pieces, or alternatively a press stud, or alternatively again a strap and buckle. The tongue could end in a bead which engages underneath a co-operating inwardly turned flange of a clip on the support, the clip then being pressed downwardly against the support to secure the container.

Another variation is for the tongue described above to be constituted by a single long strip running inside the container, the opposite ends of which emerge through opposed corner apertures to be strapped down to co-operating clips at each end of the support batten.

In yet another embodiment of the invention the tongues from the container could be made of metal or a relatively rigid plastic material, and could be pushed through the base fold lines of (say) a fibre board container to emerge and engage co-operating support clips, the tongues in this case automatically forming the required apertures in the container as they are pushed through.

As has already been stated, the invention is equally applicable to such things as open-topped cartons and pallets as well as closable packing cases. A simple form of pallet has its base formed by folding under, along parallel fold lines, two flaps which are folded towards one another to meet without overlapping. In this case, apertures can be formed in the fold lines and tongues either inserted, or pushed through to form the apertures from between the folded sheets to be secured to cooperating support clips.

FIG. 3 shows a modified form of tongue and clip. The tongue is similar in overall appearance to the tongue of FIG. 2, but its head has been specially formed to retain the tongue on the container after the tall end of the tongue has been pushed through the container from inside. The tongue is made from a resilient plastic material and is serrated in the same way as the tongue of FIG. 2.

The clip shown in FIGS. 3A, 3B, and 3C is also a resilient plastic moulding; and is nailed beneath the top strip of the support batten as was done with the clip of FIG. 2. This alternative clip comprises a square plate, two adjacent edges of which are lipped to locate the clip against corresponding corner edges of the batten strip prior to nailing the strip down. The mouth of this clip is specially formed so that the tongue can be inserted into it in the direction Y (see FIG. 3B), and the inside front face of this mouth is again formed with serrations which interlock with those on the tongue. Thus, as with the clip and tongue shown in FIG. 3D of FIG. 2, the tongue can be pulled down tight into the clip and will "ratchet" past the serrations on the inside of the clip, but if the tongue is attempted to be pulled upwardly out of the clip the two sets of serrations will interlock to prevent this. The tongue and clip, once joined, can only be separated by cutting the tongue.

We claim:

1. A pallet and container assembly comprising in combination:

a container for goods having four sides and a base, on which goods are to rest, which comprises bottom flaps folded towards one another from the four sides of the container, the folds thereby defining a lower peripheral edge around the container, four corner apertures extending through the lower peripheral edge and defined between lateral edges of each pair of next adjacent ones of said bottom flaps;

a pallet which in use spaces the container base from the ground;

a flexible strap-like tongue extending through each of said four corner apertures and comprising an enlarged head, within the container, to prevent the tongues being pulled completely through said apertures;

clips firmly secured to the pallet at points which align with said tongues when the container is positioned on the pallet, said tongues being formed so as to be interlocked with said clips and so secure the underside of the container to and pull the underside progressively more tightly against the pallet without the tongues being pulled completely through the apertures; and said tongues being cuttable to release the container from the pallet.

2. The combination of claim 1, in which the tongues and clips are formed with serrations which, when a tongue engages a corresponding clip, interlock in such a way that the tongue can be pulled progressively more tightly into engagement with the clip but cannot, at any stage of such engagement, be either wholly or partly disengaged.

3. The combination of claim 1, in which each enlarged head is formed integrally with the respective tongue, will not pass through the corresponding aperture, but allows the respective tongue to be subsequently withdrawn from the corresponding aperture in the opposite direction in which it was inserted.

4. The combination of claim 1, in which the material from which the flaps are made is sufficiently thick that, to permit subsequent folding of the flaps towards one another, finite gaps have to be left between adjacent base flaps when cutting the container blank.

5. The combination of claim 1, in which the container is rectangular in plan and each of the tongues emerges from a corresponding one of each of the four corner apertures to locate two separate pallet boards one along each opposite side of the container.

6. The combination of claim 2, in which the clips also comprise flexible strap-like members, the clips and tongues are substantially identical with one another, each is formed integrally at one end with an enlarged head defining a through-passage, and the through-passage is internally-serrated.

7. The combination of claim 1 having been formed from a kit which includes a blank from which can be formed the container whose base comprises the flaps folded towards one another from side portions of the blank to define the lower peripheral edge around the container; the pallet which when secured to the underside of the assembled container will space the base of the container from the ground; a number of the clips secured to the pallet; and a corresponding number of the cooperating flexible strap-like tongues, each of which is so sized and shaped that it can be pushed through an associated corner aperture formed in said lower peripheral edge of the assembled container to emerge from said aperture and interlock with a cooperating one of said number of clips, to secure the pallet firmly in position against the underside of the container without the strap itself being pulled completely out of the corresponding corner aperture.

* * * * *